United States Patent [19]

Krug

[11] 4,044,575

[45] Aug. 30, 1977

[54] BALANCED BI-DIRECTIONAL STRETCH KNIT FABRIC

[76] Inventor: Herbert A. Krug, 402 Semino Road, Northvale, N.J. 00647

[21] Appl. No.: 717,134

[22] Filed: Aug. 24, 1976

[51] Int. Cl.[2] ..... D04B 23/08

[52] U.S. Cl. ..... 66/192; 66/190

[58] Field of Search ..... 66/190, 192, 193, 195

[56] References Cited

U.S. PATENT DOCUMENTS

| | | | |
|---|---|---|---|
| 2,149,031 | 2/1939 | Schonfeld | 66/192 |
| 2,149,032 | 2/1939 | Schonfeld | 66/192 |
| 3,077,758 | 2/1963 | Siciliano | 66/193 |
| 3,389,582 | 6/1968 | Alexander | 66/192 |
| 3,552,155 | 1/1971 | Hartung | 66/192 |
| 3,733,859 | 5/1973 | Wittmann | 66/193 |

*Primary Examiner*—Ronald Feldbaum

[57] ABSTRACT

An elastic warp knit fabric having balanced bi-directional stretch is disclosed. The fabric comprising in combination an inelastic knitted ground structure and an elastic inlayed thread.

3 Claims, 2 Drawing Figures

BALANCED BI-DIRECTIONAL STRETCH KNIT FABRIC

BACKGROUND OF THE INVENTION

This invention relates to the field of knit fabrics. More particularly it relates to the field of elastic warp knit fabrics and the method of making the same.

In the past a variety of elastic fabrics have been produced for use in the construction of foundation garments, swimwear and the like. These fabrics, for obvious reasons, must possess certain properties such as good bi-directional stretch, as well as vigorous recovery referred to as "power".

Widthwise stretch, is of particular importance since it permits the finished garment to stretch with the movement of the wearer and thereby prevents the garment from riding up, sliding or binding. Furthermore the need for a fabric having balanced stretch also arises in the construction of brassiers and other garments which require heat moldability since a balanced stretch fabric expands uniformly and therefore does not distort in the molding process.

U.S. Pat. No. 2,960,855 discloses an elastic fabric known in the textile trade as "power net". This fabric has substantially more stretch in the warp direction than in the width direction, due to the warp wise configuration of the elastic inlay threads.

Other fabrics, such as those disclosed in U.S. Pat. Nos. 3,064,885; 2,996,906 and 3,390,549 have obtained a balanced, bi-directional stretch by knitting the elastic threads with the inelastic threads. These fabrics, however, possess a number of substantial disadvantages in that they have a relatively high elastic yarn content. Also, in order to produce a fabric of normal weight using this technique it is necessary to use a fine denier elastic yarn, these yarns are quite costly thereby resulting in a fabric which is relatively expensive. Moreover, these fabrics have a tendency to curl, which makes the cutting and sewing of them difficult.

Another technique used for producing fabrics having balanced bi-directional stretch involves the laying in of elastic yarns in both the warp and weft direction. This technique may be accomplished, as would be understood by one skilled in the art, by the use of weft insertion equipment, wherein a continuous weft yarn is inserted across the fabric width. Although the presence of elastic threads in the warp and weft directions, impart to these fabrics balanced bi-directional stretch, the resulting fabric has a high percentage of elastic yarn and is quite difficult to knit, thereby substantially increasing the cost of the fabric.

Unlike the prior art fabrics discussed above, the fabric of the present invention is capable of balanced bi-directional stretch while consuming a minimum of elastic yarn without the need for expensive weft insertion equipment.

SUMMARY OF THE INVENTION

The present invention relates to an elastic knit fabric having two way balanced stretch. It comprises an inelastic ground structure in combination with an inlaid elastic thread. This inelastic ground structure is knitted using a six course repeating stitch comprising essentially a two step "Atlas" section followed by one course of chaining, another two course Atlas section and one course of chaining. The inlaid thread is held into the ground structure by means of floats within the ground structure.

Accordingly, it is an object of the present invention to provide a fabric which is capable of balanced bi-directional stretch suitable for use in foundation garments.

Another object of the invention is to provide a two way stretch fabric which has a low elastic yarn content.

A further object of the present invention is to provide a balanced bi-directional stretch fabric which is thin and compact so as to prevent foundation garment outline from showing through a wearer's outer garments.

Another object of the present invention is to provide a balanced bi-directional stretch fabric which will have good moldability properties.

Still another object of the present invention is a fabric which embodies all of the above mentioned properties while still being economical to produce.

Still other objects and advantages of the present invention will be obvious and in part be apparent from the specification and attached drawings.

DESCRIPTION OF THE PREFERRED EMBODIMENT

Figure 1:
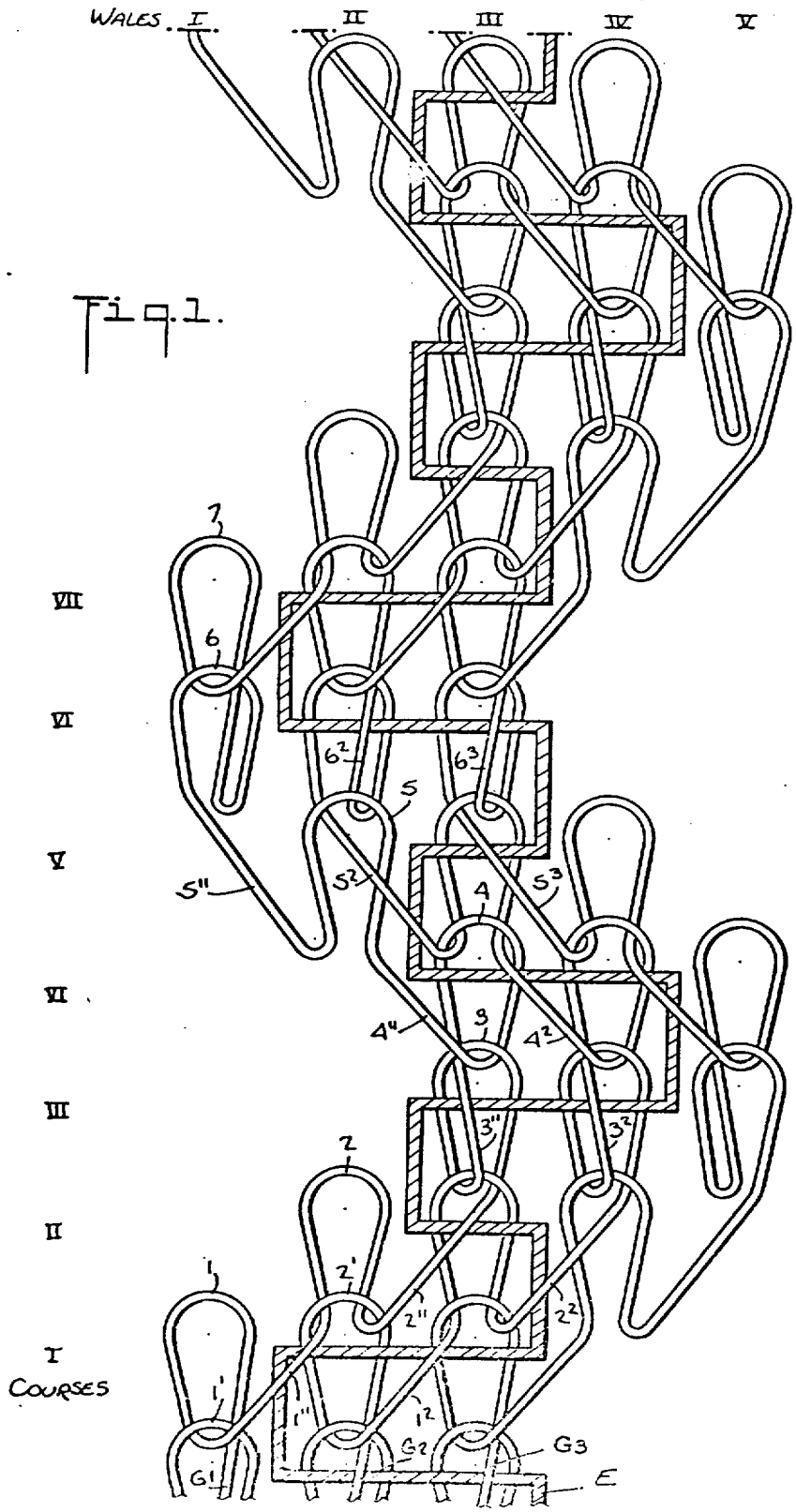
FIG. 1 shows a schematic illustration of the loop structure of a segment of the invented fabric.

As shown in the drawings the fabric of the present invention comprises essentially two yarns, an inelastic yarn which is knitted to form the ground structure and an elastic yarn which is laid into the ground structure to give the fabric its stretch characteristics.

Referring more particularly to the drawings, attention is first directed to FIG. 1 wherein three inelastic ground threads and one elastic inlay thread of the present fabric are shown. Thread, G1, G2 and G3 designate the inelastic ground threads which are knitted to form the ground structure of the fabric. Thread E designates the inlaid elastic thread.

To more particularly point out the novelty of the present fabric construction the path of only one thread G1 will be described in detail, since the paths of G2 and G3 are similarly knitted. It should be noted that the inelastic G threads are front-bar threads, and the E threads are back-bar threads.

As can be seen in FIG. 1 thread G1 forms loop 1 on course I in wale I. This loop, as would be understood by one skilled in the art, is a closed lap loop characterized by its crossed loop components at base 1'. After forming loop 1, thread G1 floats diagonally by means of float 1" to course II in wale II where it forms loop 2. As can be seen, loop 2 is an open lap loop in that its lower components are uncrossed at 2'. Thread G1 then proceeds to float diagonally to course III where it forms open lap loop 3 in wale III. It should be noted that this order of loop formation is called an "Atlas Traverse". Moreover, since loops 2 and 3 were formed in two steps, via floats 1" and 2", the traverse is designated a two step Atlas.

On course IV, thread G1 does not traverse to the next wale but rather forms loop 4 directly above loop 3 on wale III, thereby causing float 3" to be almost vertically configurated. This vertical movement of thread G1 in forming a loop directly above the previous loop is called "pillar chaining" or simply chaining.

On course V, thread G1 traverses diagonally back to wale II by means of float 4 to form open lap loop 5. On course V1, G1 again traverses diagonally to the left to wale I via float 5 to form loop 6. On course VII thread G1 forms loop 7 directly above loop 6 in wale 1.

It can be seen from FIG. 1 that loop 7 is identical in configuration and wale location to loop 1, and from this point on the stitch pattern of thread G1 repeats itself on 6 course intervals. Therefore, the ground bar pattern or lapping movements may be said to consist of a two step diagonally traversing Atlas section, followed by one course of chaining followed by another two step diagonally traversing Atlas section in the opposite wale direction, followed by one course of chaining.

Elastic inlay thread E is held in the inelastic ground structure by floats such as 1", 2" and 3" as can be seen from FIG. 1. The number of such floats securing the inlay threads E are dependent upon the amplitude and direction of movement of thread E, i.e. the number of needle spaces traversed and whether thread E is moving in the same or opposite direction of the floats.

The number of floats holding the elastic inlay in the ground structure may be expressed as: $N=Ng+d$; wherein $N$ is the number of floats holding the inlay, $Ng$ is the effective length of the inlay traverse, expressed in needle spaces and $d$ represents the direction of the float. If the elastic inlay is moving in the same direction as the inelastic ground float then $d$ is represented as $-1$; if however the elastic inlay is moving in a direction opposite than that of the inelastic ground float then $d$ is represented by $+1$. For example, referring again to FIG. 1 inlay thread E traverses across one needle space in the opposite direction as the floats in course 2, accordingly $1+1=2$ floats, i.e. 2" and $2^2$.

As would be understood by one skilled in the art, this equation is valid only for single needle underlap fabric constructions. For example, the above equation would not apply on course 3, where the elastic inlay E is moved across two needle spaces, since no underlapping movement is performed by the inelastic threads $G_1$ or $G_2$. However, it can be seen from an examination of FIG. 1 that the inlay thread E will be held in place by vertical floats 3" and $3^2$.

The fabric of the present invention exhibits a number of substantial advantages in its physical properties over similarly knitted prior art fabrics. For example, the fabric of the present invention possesses a high degree of width-wise stretch when compared to prior art fabrics which use a knit ground and elastic inlay construction. Such prior art fabrics, during finishing shrink only to approximately 80% of their knitting width making it difficult for them to develop a good width-wise stretch. The fabric of the present invention, on the other hand shrinks to approximately 50% of its knitting width, therefore permitting it to develop a greater amount of width-wise stretch when compared to similar prior art fabrics.

Another important property of stretch fabrics is their strain or load to elongation ratio which is used for judging the suitability of the fabrics for various end uses. It has been found that the fabric of the present invention has a load to elongation ratio or modulus which is far superior to those prior art fabrics using a knit ground and elastic inlay construction.

Furthermore, the fabric of the present invention gives a soft hand and a fabric surface as opposed to a net surface. Moreover, the fabric of the present invention is capable of a control type stretch in either direction as opposed to other fabrics which may give equal stretch in both directions but are only of a controlled type stretch in one direction, the other being a long comfort type stretch. Therefore, it is possible employing the fabric of the present invention to make certain garments using either direction around the body for control.

FIG. 1 is a schematic drawing of the loop structure of the present invention and does not depict the actual configuration of the elastic and inelastic loop components in the actual fabric. This is due to redistribution of the elastic inlay threads and distortion of the inelastic ground loops both of which are caused by the tension of the inlay thread.

Figure 2:
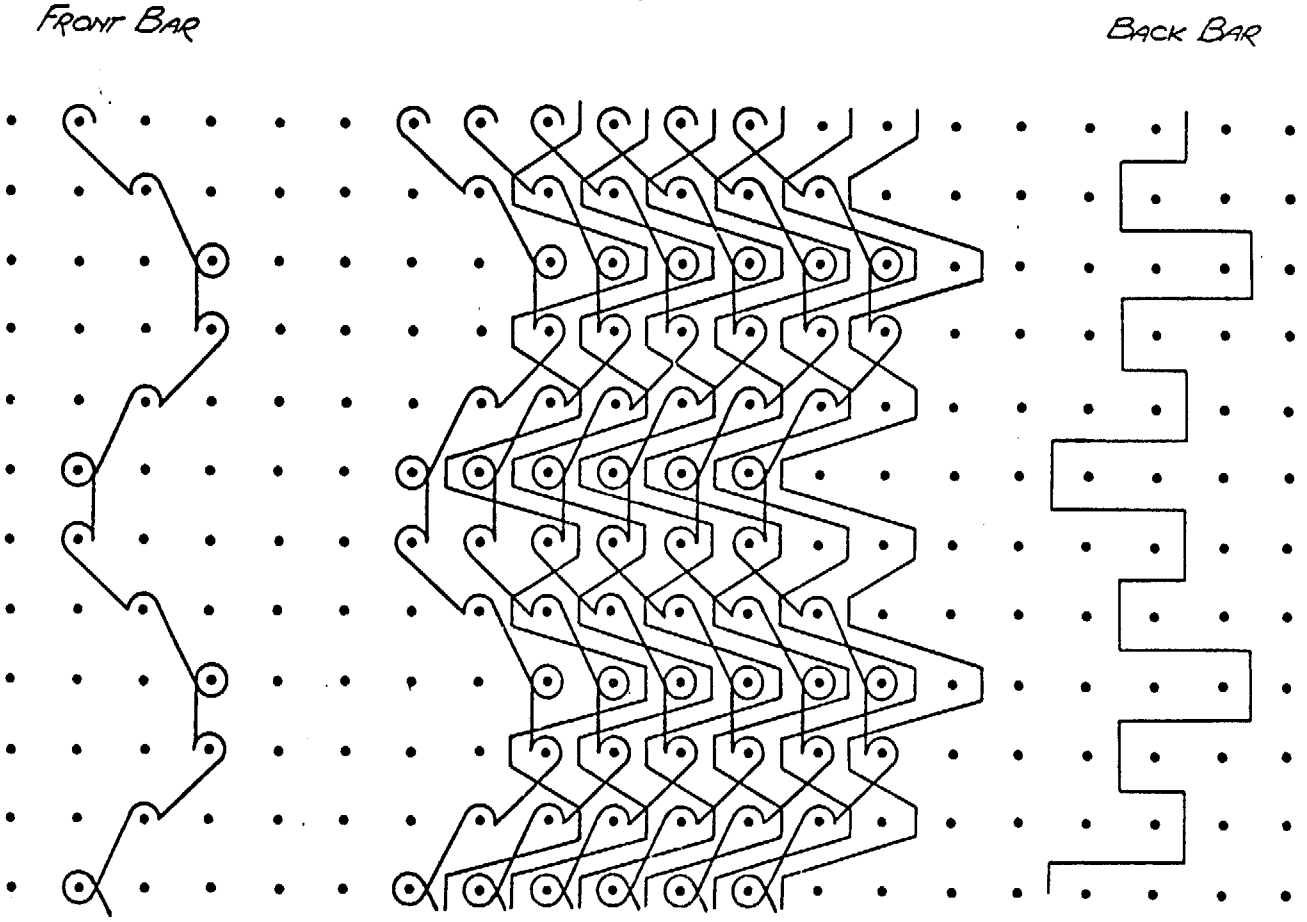
FIG. 2 shows the stitch pattern of the present invention in a point diagram.

FIG. 2 depicts the construction of the present fabric in a point diagram. As can be seen from the left hand side of FIG. 2 the front bar knits the inelastic ground construction in a manner which coincides with that of G1, G2 and G3 shown in FIG. 1. The movement of the back bar as shown on the right hand side of FIG. 2 lays in the elastic yarn in a manner which coincides with that of yarn E in FIG. 1. In the center of FIG. 2 the combined movements of both the back and front bars are shown. For the purpose of clarity, the lines depicting the shogged portion of the elastic thread E in the combined drawings of FIG. 2 have been depicted as being slightly inclined such that they do not merge with the lines representing the inelastic yarns.

In forming the fabric of the present invention, the following bar movements are used:

Bar 1 (front bar) 1-0, 1-2. 3-2, 2-3, 2-1, 0-1

Bar 2 (back Bar) 0-0, 2-2, 1-1, 3-3, 1-1, 2-2.

The above patterns are Tricot designations and can be readily converted to Raschel designations by those skilled in the art.

The bar movements depicted above designate a fabric having an open and closed loop construction for the front bar in the following sequence: closed, open, open, closed, open, open. As would be understood by one skilled in the art, this loop construction sequence of the inelastic yarn may be changed without destroying the fabric's superior physical characteristics; for example, the inelastic yarn may be knitted such that all the loops are closed or all the loops are open, alternately the loop construction may alternate between open and closed loops.

In another embodiment of the present invention the elastic inlay thread may be laid in using the following modified bar movement:

Bar 2 (back bar) 2-2, 1-1, 3-3, 1-1, 2-2, 0-0.

In the above description, the invention has been disclosed merely by way of example and in preferred manner; but many variations and modifications may and will be apparent to one skilled in the art while the resulting fabric will still remain within the general spirit of the invention, for example the front guide bar movement may be modified to form closed lap loops in lieu of open laps and vice versa.

It is to be understood, therefore, that the invention is not limited to any specific form or manner of practicing the same, except insofar as such limitations are specified in the claims.

What is claimed is:

1. A warp knitted stretch fabric capable of balanced bi-directional stretch having in combination an inelastic knitted ground structure and elastic lay in, said ground structure comprising a plurality of courses and wales formed from single stitches, said single stitches being deposed in a six stitch repeating pattern, the first three stitches of said six stitch repeating pattern traversing diagonally to adjacent wales and courses, the fourth stitch of said six stitch repeating pattern being knitted in the same wale and adjacent course as the third stitch of said six stitch repeating pattern, the fifth and sixth stitches of said six stitch repeating pattern traversing diagonally from said fourth stitch to adjacent wales and courses said diagonally traversing being in a direction opposite that of the traversing of said first, second and third stitches, and an elastic thread extending through said ground structure and being held into said ground structure by the unknitted portions of said inelastic ground structure.

2. A warp knitted stretch fabric as defined in claim 1 wherein said inelastic threads are knitted by the bar movement pattern, 1-0, 1-2, 3-2, 2-3, 2-1, 0-1, and said elastic yarn is laid into said inelastic threads by the bar movement pattern 0-0, 2-2, 1-1, 3-3, 1-1, 2-2, said movement patterns being Tricot designation.

3. A warp knitted stretch fabric as defined in claim 1 wherein said inelastic threads are knitted by the bar movement pattern, 1-0, 1-2, 3-2, 2-3, 2-1, 0-1, and said elastic yarn is laid into said inelastic threads by the bar movement pattern 2-2, 1-1, 3-3, 1-1, 2-2, 0-0, said movement pattern being Tricot designation.

* * * * *

UNITED STATES PATENT OFFICE

CERTIFICATE OF CORRECTION

Patent No. 4,044,575 Dated August 30, 1977

Inventor(s) Herbert A. Krug

It is certified that error appears in the above-identified patent and that said Letters Patent are hereby corrected as shown below:

Cancel the drawings bearing Patent No. 4,044,475, and insert the Two Sheets of Drawings as part of Letters Patent 4,044,575.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*

Herbert A. Krug

Herbert A. Krug